United States Patent [19]

Celander

[11] Patent Number: 4,933,522

[45] Date of Patent: Jun. 12, 1990

[54] FLANGED SNAP DOME

[75] Inventor: Ronald C. Celander, Eden Prairie, Minn.

[73] Assignee: ITT Corporation, New York, N.Y.

[21] Appl. No.: 324,877

[22] Filed: Mar. 7, 1989

[51] Int. Cl.[5] ..... H01H 3/12

[52] U.S. Cl. ..... 200/513; 200/516

[58] Field of Search ..... 200/516, 513, 406, 5 A, 200/517

[56] References Cited

U.S. PATENT DOCUMENTS

| | | | |
|---|---|---|---|
| 2,409,483 | 10/1946 | Gandelot | 200/406 |
| 3,908,109 | 9/1975 | Studebaker | 200/275 |
| 3,967,084 | 6/1976 | Pounds | 200/275 |
| 4,085,306 | 4/1978 | Dunlap | 200/275 |
| 4,195,210 | 3/1980 | Pounds et al. | 200/516 |
| 4,319,099 | 3/1982 | Asher | 200/513 X |
| 4,343,973 | 8/1982 | Main | 200/516 |
| 4,430,531 | 2/1984 | Wright | 200/5 A |
| 4,476,355 | 10/1984 | Mital | 200/5 A |
| 4,499,343 | 2/1985 | Prioux et al. | 200/5 A |
| 4,508,942 | 4/1985 | Inaba | 200/5 A |
| 4,598,181 | 7/1986 | Selby | 200/5 A |
| 4,604,509 | 8/1986 | Cloney et al. | 200/513 |
| 4,611,261 | 9/1986 | Suwa | 200/5 A |
| 4,703,139 | 10/1987 | Dunlap | 200/406 |

*Primary Examiner*—Renee S. Luebke

*Attorney, Agent, or Firm*—Thomas L. Peterson

[57] ABSTRACT

A contact element is provided, of the type having a domed middle portion that can be manually deflected against a terminal to close an electrical circuit, which avoids damage to the circuit and which can be easily held in place. The contact element has a domed middle portion with a convex front face, a peripheral portion, and a bend between the middle and peripheral portions. The contact element is laid against a printed circuit board, with the bend contacting a first terminal on the board and the middle portion being deflectable to contact a second terminal on the board. An insulative actuator has a button portion that can be pressed against the middle of the contact element, an outer capture portion which captures the outer edge of the contact element, and a hinge connecting the button and capture portions. The outer edge of the contact element lies away from the circuit board so burrs thereon cannot damage the circuit board, and so that the periphery of the contact element can be easily captured.

2 Claims, 2 Drawing Sheets

FIG. 1
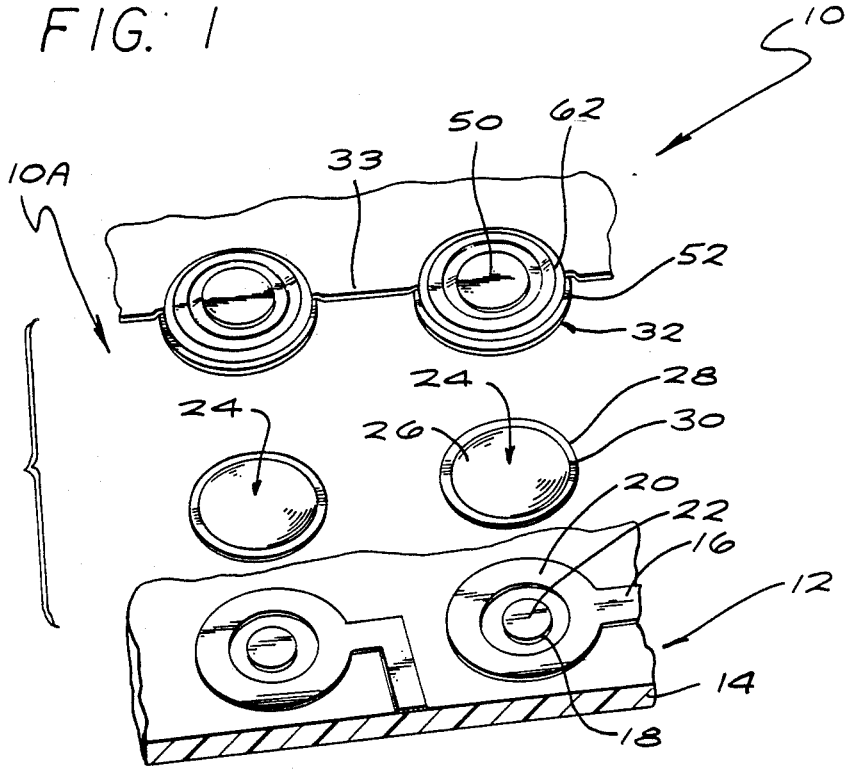
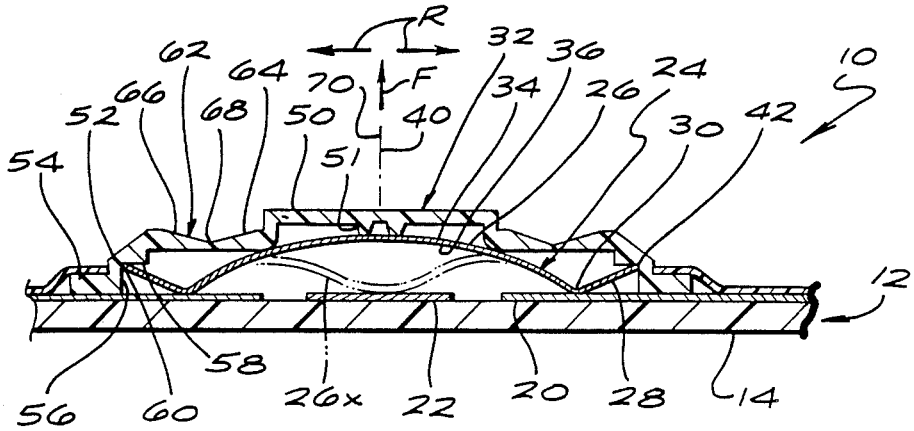
FIG. 2

FLANGED SNAP DOME

BACKGROUND OF THE INVENTION

One type of switch includes a dome shaped contact element whose periphery rests on one terminal of a circuit board, and whose middle can be deflected against another terminal of the circuit board. Care must be taken to minimize burrs at the outer edge of the element, as such burrs can cut the thin conductive or insulative films on the circuit board, and stress concentrations at the burrs can cause premature failure of the contact element. Care must also be taken to capture the outer edge of the contact element where the outer edge lies against the circuit board. A contact element which avoided damage to the circuit board despite the presence of burrs at its outer edge, and which was easy to capture, would be of considerable value.

SUMMARY OF THE INVENTION

In accordance with one embodiment of the present invention, a contact element and switching assembly are provided, which enable high reliability in switching. The contact element has a largely dome-shaped middle portion with a convex front face and concave rear face, a peripheral portion, and a bend at the intersection of the middle and peripheral portions. The peripheral portion extends in a forward-radially outward direction, so when the contact element is installed on a circuit board the bend contacts the circuit board while the peripheral edge lies away from the circuit board. The switching assembly can include an actuator with a middle or button portion lying over the middle of the contact element, and a capture portion which captures the periphery of the contact element. The actuator can include a circular hinge, where the actuator is of reduced diameter, between the button portion and the capture portion, to facilitate rearward deflection of the button portion where the actuator is formed of a relatively rigid, nonelastomeric plastic.

The novel features of the invention are set forth with particularity in the appended claims. The invention will be best understood from the following description when read in conjunction with the accompanying drawings.

BRIEF DESCRIPTION OF THE DRAWINGS

FIG. 1 is ar exploded perspective view of a switching assembly constructed in accordance with the present invention.

FIG. 2 is a sectional view of a portion of the switch assembly of FIG. 1, with the vertical dimensions exaggerated.

DESCRIPTION OF THE PREFERRED EMBODIMENTS

Figure 5:
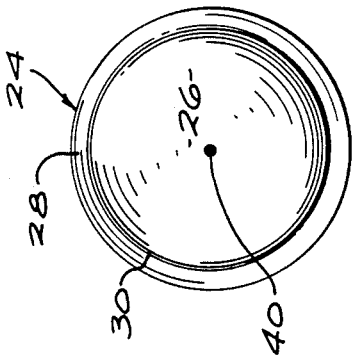
FIG. 5 is a plan view of the contact element of FIG. 4.

FIG. 1 illustrates a switching assembly 10 which includes a circuit d<vice 12 of the printed circuit board type, having a base 14 and having film conductors 16, 18 which may be of a foil or other type. The film conductors form concentric first and second terminals 20, 22 which can be connected together to close a circuit. It may be noted that the central film conductor 18 may connect to other circuitry through a plated-through hole (not shown) in the base. A contact element 24 is used to connect the terminals 20, 22. The contact element is largely dome-shaped, with a middle portion 26 that can be deflected against the second terminal 22. The contact element also has a peripheral portion 28, and a bend 30 connecting the middle and peripheral portions. The bend 30 contacts the first terminal 20. An actuator 32 is used to deflect the middle portion of the contact element, and also to capture the contact element. An adhesively mounted hold-down film 33 holds the actuator in place on the circuit board or circuit device 12. In applications such as keyboards, many of such switching assemblies may be provided, two of them 10, 10A being shown in FIG. 1.

Figure 2A:
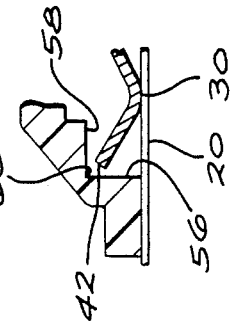
FIG. 2A is an enlarged view of a portion of the switch assembly of FIG. 2.

FIG. 2 illustrates details of the switching assembly 10. The contact element 24 has front and rear faces 34, 36, with the front face being convex along the middle portion 26. The rear face of the element at the bend 30 contacts a first terminal 20. The contact element has an axis 40 extending through the middle portion, and the peripheral portion 28 extends in a forward-radially outward direction (in the direction of arrow R) from the bend 30. That is, locations along the peripheral portion 28 that are progressively further from the axis 40 lie progressively more forward along the direction of arrow F. In most applications, the contact element 24 is symmetrical about its axis 40, with the bend 30 extending in a circle and with the outer edge 42 of the contact element being circular. Of course, the contact element can have other shapes such as an oval shape, instead of the circular shape shown in FIG. 5.

The actuator 32 is preferably formed of a relatively rigid plastic material, instead of an elastomeric material, for greater ruggedness and longer life. The actuator includes a center or button portion 50 with an engaging part 51, which can be manually depressed to deflect the contact element middle portion rearwardly to the configuration 26x against the terminal 22. The actuator includes a capture portion 52 with a mount part 54 that mounts on the circuit board over the base 14 thereof. The capture portion forms a shoulder 56 which lies closely around the outer edge 42 of the contact element to closely locate the contact element. There is a slight clearance around edge 42 to avoid restriction of the dome during snap-through. The capture portion also includes a second surface 58 which also substantially abuts the outer edge of the contact element to hold it down so the bend in the contact element lies against the first terminal on the circuit board. The actuator is preferably formed so its surface captures the outer edge 42 of the contact element to fix the location of the contact element. The two surfaces 56, 58 form a corner 60. The actuator also includes a hinge portion 62 between the button portion 50 and capture portion 52. The hinge portion includes inner and outer regions 64, 66 and a hinge region 68 between them that is of smaller thickness than the inner and outer portions, such as less than half as thick. The hinge region 68 facilitates rearward movement of the button portion 50 to deflect the contact element, even though the actuator is formed of relatively hard and stiff plastic instead of an elastomeric polymer. The actuator has an axis 70 concentric with the contact element axis 40, and the hinge 68 preferably extends in a circle about the button portion.

The construction of the contact element with a bend 30 extending on an imaginary plane 72 (FIG. 3) and against the circuit device 12 (the terminal 20 thereof) has the advantage of providing contact between the contact assembly and circuit device at a location which is free of burrs. Burrs, which commonly occur at the outer edge 42 of the contact element where it is cut from a sheet of material, could otherwise cut into the circuit board, and possibly cut through any insulation on a conductor (as where the second terminal 22 extends under the first terminal with insulation between them) or into the terminal. By having the peripheral portion 28 tilted to extend at an angle away from the circuit device, the edge 42 of the contact element is held away from the circuit device. As a result, less care has to be taken to avoid or remove burrs at the outer edge of the contact element. Placing the edge 42 of the contact element so it is spaced forward of the circuit device, also helps in capturing the outer edge of the contact element. If the outer edge of the contact element lay against the circuit device 12, then it would be possible for the edge of the contact element to creep under a shoulder similar to 56 which is intended to hold it in position. The provision of a radially outwardly-forwardly extending peripheral portion also aids in stacking of contact elements on one another, as shown in FIG. 3.

Figure 3:
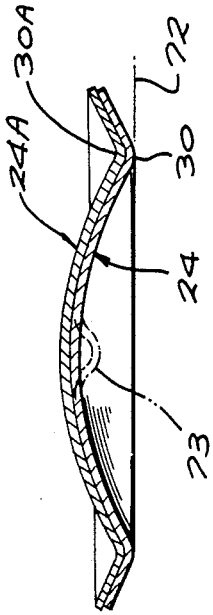
FIG. 3 is a sectional view of a contact element of FIG. 1, with an additional contact element stacked thereon, and with the vertical dimensions exaggerated.

In FIG. 3, two contact elements 24, 24A are provided with one lying substantially against a face of the other. The bend 30, with locations on opposite sides of the bend lying progressively more forward, at locations progressively further from the bend 30, results in enabling the second contact element 24A to closely nest in the first contact element 24. Two contact elements are provided to increase the force required to close the "switch" formed by the contact elements and terminals. When the middle of the contact element is depressed, the portion of the contact element at the bend 30 is stressed. The peripheral portion 28 of the contact element which contains any burrs at its outer edge 42, is substantially free of repeated stressing, so that stress concentrations at such burrs and consequent cracks leading to failure of the contact elements, is avoided. FIG. 3 shows, in phantom lines at 75, the possibility of having a depression in the primarily dome-shaped middle portion of the contact element.

Figure 4:
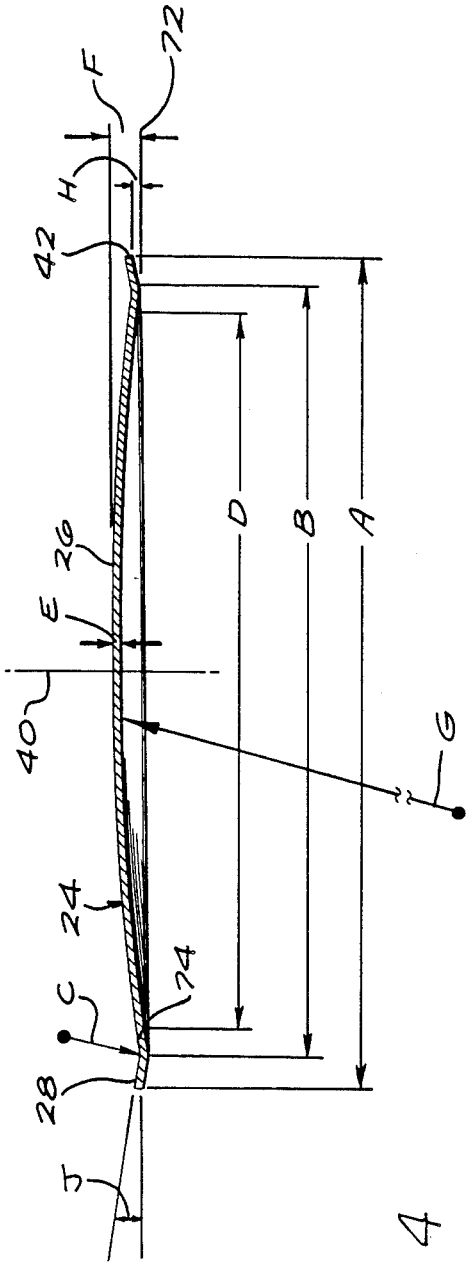
FIG. 4 is a sectional view of a contact element of FIG. 1, without substantial exaggeration of vertical dimensions.

FIG. 4 illustrates an actual contact element 24 which applicant has constructed and tested. The element has an outside diameter of 0.350 inch, and a diameter B at the bend 30 of 0.325 inch. The bend 30 is the most rearward location of the contact element and the location where it contacts the first terminal of the circuit assembly. The contact element has a radius of curvature C of 0.03 inch at the bend, with the radius of curvature extending from a location 74 of a diameter D of 0.300 inch. The contact element is formed of a sheet of type 304 stainless steel, with a thickness E of 3 mil (one mil equals one thousandth inch). The contact element has an overall height F of 10 mil. The radius of curvature G of the middle portion 26 up to the location 74 is 1.45 inch. The height or distance H of the bottom of the extreme edge 42 over the bottom of the bend 30 is 2.7 mil. With the bend 30 lying on a horizontal plane, the outer edge of the peripheral portion 28 extends at an angle J of between 5° and 10°. A relatively small angle of less than 30° and preferably less than 20° is desirable in order to minimize stresses on the metal blank when forming it into the shape of the contact element, and yet this angle is sufficient to keep the burrs at the extreme of the contact element away from the circuit device. The hold-down film 33 (FIG. 1) which holds the actuators and seals them to the circuit device, is a polyester sheet of 0.5 mil thickness.

Thus, the invention provides a switching assembly and especially a contact element thereof, which provides ruggedness and an extended lifetime of use. The contact assembly has a largely domed middle portion, a bend around the middle portion for contacting a conductor, and a peripheral portion extending outwardly and away from the conductor. This arrangement keeps burrs at the outer edge of the contact assembly away from the conductors, facilitates capturing the outer edge of the contact assembly, and facilitates stacking of one contact element on another for increased mechanical resistance to switch closing. An actuator for deflecting the contact element can include a capture portion with a shoulder that substantially abuts the outer edge of the contact element to locate it. The actuator also includes a circular hinge region of reduced thickness which facilitates rearward deflection of the button portion of the actuator.

Although particular embodiments of the invention have been described and illustrated herein, it is recognized that modifications and variations may readily occur to those skilled in the art and consequently it is intended to cover such modifications and equivalents.

What is claimed is:

1. Apparatus for electrically connecting a pair of terminals by depression of the apparatus, comprising:

a circuit device which includes an electrically insulative base and first and second conductors lying on said base and forming first and second terminals;

a contact element resting over said base and having a middle portion with a substantially convex front face and concave rear face and having an imaginary axis, said middle portion lying directly in front of said second terminal and being deflectable rearwardly thereagainst, said element having a peripheral portion which extends in a forward-radially outward direction, and said element forming a bend at an intersection of said middle and peripheral portions, said bend bearing against said first terminal;

an actuator of insulative material with a button portion lying over said middle portion of said contact element, a capture portion surrounding said contact element, and a hinge portion connecting said button and capture portions;

said peripheral portion of said contact element has a radially outer edge that lies forward of said bend;

said capture portion of said actuator forms a corner which includes a first surface forming a primarily radially-inwardly facing shoulder which closely surrounds said outer edge of said contact element, and a second surface angled from said first surface and which substantially abuts said outer edge.

2. Apparatus for electrically connecting a pair of terminals on a circuit device by depression of the apparatus, comprising:

a contact element having a middle portion with a substantially convex front face and concave rear face and having an imaginary axis, said element having a peripheral portion which extends in a forward-radially outward direction, and said element forming a bend at an intersection of said middle and peripheral portions, and said element peripheral portion having a radially outer edge that lies forward of said bend;

a one-piece actuator of insulative material with a button portion lying over said middle portion of said contact element, a capture portion surrounding said contact element, and a hinge portion integral with and connecting said button and capture portions and allowing said button portion to move rearwardly and forwardly with respect to said capture portion, said capture portion forming a primarily radially-inwardly facing shoulder which closely surrounds said outer edge of said contact element peripheral portion to limit sideward movement of said contact element.

* * * * *